US009155369B2

(12) United States Patent
Santy

(10) Patent No.: US 9,155,369 B2
(45) Date of Patent: Oct. 13, 2015

(54) FRAME STRUCTURE FOR A LUGGAGE ITEM

(71) Applicant: Samsonite IP Holdings S.a.r.l., Luxembourg (LU)

(72) Inventor: Dirk Santy, Koekelare (BE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 14/073,156

(22) Filed: Nov. 6, 2013

(65) Prior Publication Data

US 2014/0131155 A1 May 15, 2014

(30) Foreign Application Priority Data

Nov. 13, 2012 (EP) ..... 12192405

(51) Int. Cl.
*A45C 13/04* (2006.01)
*A45C 13/10* (2006.01)

(52) U.S. Cl.
CPC ..... *A45C 13/04* (2013.01); *A45C 13/103* (2013.01)

(58) Field of Classification Search
CPC ..... A45C 13/04; A45C 13/103
USPC ..... 190/119, 121, 122, 123, 124, 127, 24, 190/903, 126
See application file for complete search history.

(56) References Cited

U.S. PATENT DOCUMENTS

| | | | | | |
|---|---|---|---|---|---|
| 4,438 | A | * | 4/1846 | Hibson | 190/24 |
| 627,374 | A | * | 6/1899 | Wood | 190/115 |
| 2,318,527 | A | * | 5/1943 | Rosenthal | 223/71 |
| 2,335,950 | A | * | 12/1943 | Lynam | 190/119 |
| 2,444,511 | A | * | 7/1948 | Kaufmann | 190/119 |
| 2,492,655 | A | * | 12/1949 | Rubin | 190/119 |
| 3,098,548 | A | * | 7/1963 | Bialo | 190/123 |
| 3,135,366 | A | * | 6/1964 | Holtzman | 190/123 |
| 3,306,403 | A | * | 2/1967 | Heitler et al. | 190/115 |
| 3,468,274 | A | * | 9/1969 | Sol | 112/475.08 |
| 3,477,553 | A | * | 11/1969 | Kish, Jr. | 190/119 |
| 3,812,939 | A | * | 5/1974 | Pelletier | 190/113 |
| 3,962,010 | A | | 6/1976 | Riou et al. | |
| 4,433,760 | A | | 2/1984 | Pelavin | |
| 5,476,163 | A | * | 12/1995 | Wu | 190/115 |
| 5,529,156 | A | | 6/1996 | Yang | |
| 5,794,744 | A | | 8/1998 | Lin | |

(Continued)

FOREIGN PATENT DOCUMENTS

| | | | |
|---|---|---|---|
| CN | 2380081 | Y | 5/2000 |
| WO | 9944460 | A1 | 9/1999 |

*Primary Examiner* — Sue A Weaver

(74) *Attorney, Agent, or Firm* — Dorsey & Whitney LLP

(57) ABSTRACT

A luggage item may include a first and second outer portions defining an inner compartment of the luggage item and a closing mechanism. At least one of the first outer portion or the second outer portion may include a frame structure and a relatively flexible cover member. The closing mechanism may be configured to operably engage a peripheral edge of each of the outer portions and configured to selectively open and close the luggage item. The frame structure may include a first frame member. The first frame member may form at least a portion of the peripheral edge of the at least one of the first outer portion or the second outer portion. The first frame member may define a width dimension extending in a direction away from the peripheral edge. The relatively flexible cover member and the closing mechanism may be joined to the first frame member by a common sewn attachment.

18 Claims, 5 Drawing Sheets

(56) References Cited

U.S. PATENT DOCUMENTS

| | | | | |
|---|---|---|---|---|
| 5,894,914 | A * | 4/1999 | Jubin | 190/119 |
| 6,220,412 | B1 | 4/2001 | Lin | |
| 6,234,287 | B1 | 5/2001 | Pfeiffer | |
| 6,260,680 | B1 | 7/2001 | Lin | |
| 2004/0079604 | A1 | 4/2004 | Martin | |
| 2006/0249344 | A1 | 11/2006 | Ruby et al. | |
| 2007/0045071 | A1 | 3/2007 | Gorga | |

* cited by examiner

FRAME STRUCTURE FOR A LUGGAGE ITEM

CROSS-REFERENCE TO RELATED APPLICATION

This application claims priority to European Patent Application No. 12192405.4, filed on Nov. 13, 2012 and entitled "Frame Structure For a Luggage Item," which is hereby incorporated in its entirety by reference as though fully disclosed herein.

FIELD OF THE INVENTION

The present disclosure generally relates to luggage. More particularly, the present disclosure relates to the structure of a luggage frame for a luggage item.

BACKGROUND OF THE INVENTION

Luggage items, such as soft side suitcases, may include wire or extruded plastic reinforcement beads, honeycomb boards and/or other reinforcing panels as shape retaining structures and anchor plates for components, such as wheels and handles. To form a luggage case incorporating these frame and reinforcement structures, multiple manufacturing steps are usually involved. The wire reinforcements are first formed or bent into a predetermined shape and then received in piping, which is then attached around the perimeter of the structure requiring reinforcement. Other materials are attached to the structure in the same step, such as outer fabric, liner fabric, or the like. Reinforcing panels are held in place within the walls of the luggage case by being positioned in pockets, or separately attached to the wire frame or other panels. Not only does this wire-frame structure involve a multi-step assembly process, it adds unnecessary weight and creates interruptions at the outer panels of the luggage case, thereby restricting the aesthetic design flexibility.

Documents that may be related to the present disclosure in that they include various approaches to luggage construction include GB2339679, U.S. Pat. No. 3,962,010, U.S. Pat. No. 4,433,760, U.S. Pat. No. 5,529,156, U.S. Pat. No. 5,794,744, US2004/0079604, US2006/0249344, US2007/0045071 and CN2380081. These proposals, however, may be improved.

It is therefore desirable to provide an improved luggage construction, in particular an improved luggage frame structure, which addresses the above described problems and/or which more generally offers improvements or an alternative to existing luggage structures and construction methods.

SUMMARY OF THE INVENTION

According to the present invention there is therefore provided a luggage item as defined in the accompanying claims.

In particular described herein is a peripheral frame structure for use in split luggage items, such as soft side suitcases, hybrid suitcases, backpacks, duffels, briefcases, computer bags and so on. Also described herein is a method for forming the peripheral frame structure and for forming luggage items incorporating the peripheral frame structure.

In some implementations, the luggage item may include a first and second outer portions defining an inner compartment of the luggage item and a closing mechanism. At least one of the first outer portion or the second outer portion may include a frame structure and a relatively flexible cover member. The closing mechanism may be configured to operably engage a peripheral edge of each of the first and second outer portions and configured to selectively open and close the luggage item. The frame structure may include a first frame member forming at least a portion of the peripheral edge of the at least one of the first outer portion or the second outer portion. The first frame member may define a width dimension extending in a direction away from the peripheral edge. The relatively flexible cover member and the closing mechanism may be joined to the first frame member by a common sewn attachment.

In some implementations, the first frame member may include a varying width.

In some implementations, the first frame member may include at least a planar portion. The planar portion may extend along the width dimension away from the peripheral edge.

In some implementations, at least a portion of the relatively flexible cover member of the first outer portion, at least a portion of the closing mechanism and the planar portion of the first frame member may substantially align or overlap at a location where they are joined by the common sewn attachment.

In some implementations, at least one of a wheel assembly, a structural member, or a handle assembly may be joined to the planar portion of the first frame member.

In some implementations, the first frame member may include a portion that may include a honeycomb structure.

In some implementations, the relatively flexible cover member, the closing mechanism and the frame member may be joined together by a line of stitching through the portion of the first frame member including the honeycomb structure.

In some implementations, the relatively flexible cover member may define at least in part an exterior surface of the at least one of the first outer portion or the second outer portion. The relatively flexible cover member may be configured to substantially cover or overlap an exterior surface of the first frame member.

In some implementations, the first frame member may be configured to form a continuous loop.

In some implementations, the continuous loop may be formed by joining two ends of an elongated member. The joint of the two ends of the elongated member may be positioned adjacent to a top region of the luggage item.

In some implementations, the first frame member may further include a varying thickness across the width dimension.

In some implementations, the first frame member may include a thinner portion that may define a smaller thickness dimension of at least a portion of the width dimension of the first frame member. At least a portion of the relatively flexible cover member and at least a portion of the closing mechanism may be joined to the thinner portion of the first frame member by the common sewn attachment.

In some implementations, the thinner portion of the first frame member may be configured to be adjacent to the peripheral edge of the at least one of the first outer portion or the second outer portion.

In some implementations, the luggage item may further include a liner positioned in the interior of the luggage compartment and at least partially adjacent to an inner side of the peripheral edge of the first frame member. The liner may be joined to the first frame member by the common sewn attachment joining the relatively flexible cover member and the closing mechanism to the first frame member.

In some implementations, the luggage piece may further include a structural member for providing three-dimensional shape support to the luggage item.

In some implementations, the structural member may include a first brace member including opposing ends, and a length extending between the opposing ends. One of the opposing ends of the first brace member may be associated with a first portion of the first frame member. The other one of the opposing ends of the first brace member may be associated with a second portion of the first frame member.

In some implementations, at least a portion of the length of the first brace member may extend across an opening defined by the first frame member but in a plane different than the plane defined by the first frame member.

In some implementations, the structural member may further include a second brace member including opposing ends, and a length extending between the opposing ends. One of the opposing ends of the second brace member may be associated with a third portion of the first frame member. The other of the opposing ends of the second brace member may be associated with a fourth portion of the first frame member.

In some implementations, at least a portion of the length of the second brace member may extend across the opening defined by the first frame member but in a plane different than the plane defined by the first frame member.

In some implementations, the structural member may include at least one polymeric sheet defining at least a portion of a top of the at least one of the first outer portion or the second outer portion. The at least one polymeric sheet may be joined to the first frame member by the common sewn attachment.

In some implementations, the luggage item may include a binding element. The binding element may cover at least a portion of the length of the peripheral edge of the at least one of the first outer portion or the second outer portion. A first leg of the binding element may be positioned to the exterior of the peripheral edge, and a second leg may be positioned to the interior of the peripheral edge. The first and second legs may be joined to the first frame member by the common sewn attachment.

In some implementations, the closing mechanism may include a zipper mechanism having a pair of engageable zipper teeth.

In some implementations, the closing mechanism may include a latch mechanism.

In some implementations, the closing mechanism may further include an elongated member in an abutting relationship with the peripheral edges of the outer portions when the luggage item is closed. The elongated member may be joined to one of the outer portions by stitching.

In some implementations, the luggage item may be configured in a manner such that when the pair of zipper teeth are engaged, the engaged zipper teeth and at least one of the first frame member or the elongated member may be in an overlying, overlapping, superimposed or coextensive configuration.

In some implementations, each of the first and second outer portions may include a frame structure. The frame structure of the first outer portion may include the first frame member. The frame structure of the second outer portion may include a second frame member and a second relatively flexible cover member. The second frame member may form at least a portion of the peripheral edge of the second outer portion. The second frame member may define a width dimension extending in a direction away from the peripheral edge. The second relatively flexible cover member of the second outer portion and the closing mechanism may be joined to the second frame member by a second common sewn attachment.

In some implementations, the second frame member may further include a portion comprising a honeycomb structure. The relatively flexible cover portion of the second outer portion and the closing mechanism may be joined to the portion of the second frame member including the honeycomb structure by a line of stitching. In some implementations, the line of stitching may be positioned through the portion of the second frame member including the honeycomb structure.

In some implementations, the second frame member may include at least a planar portion. The planar portion may extend along the width dimension away from the peripheral edge.

In some implementations, at least one of a wheel assembly, a structural member, or handle assembly may be joined to the planar portion of the second frame member.

In some implementations, the width dimension of the first frame member varies along its length may define a first profile. The width dimension of the second frame member may also vary along its length and define a second profile. In some implementations, the first profile may be identical to the second profile. In some implementations, the first profile may be different from the second profile.

In some implementations, at least one of the first or second frame members may include a base portion having a larger width than at least one other portion of the first or second frame members.

In some implementations, at least one of the first or second frame members may include a first end and a second end coupled to each other at a top portion of the frame member.

In another implementation of a luggage item, the luggage item may include a first and second outer portions defining an inner compartment of the luggage item and a frame structure. The frame structure may include a first frame member and at least one brace member. The first frame member may form at least a portion of a peripheral edge of at least one of the first outer portion or the second outer portion. The first frame member may define a width dimension extending in a direction away from the peripheral edge. The at least one brace member may include opposing ends, and a length extending between the opposing ends. One of the opposing ends of the at least one brace member may be associated with a first portion of the first frame member. The other one of the opposing ends of the at least one brace member may be associated with a second portion of the first frame member.

In some implementations, at least a portion of the length of the at least one brace member may be configured to extend across an opening defined by the first frame member but in a plane different than the plane defined by the first frame member.

Advantageously, the various frame structures described herein and the luggage item incorporating the frame structures improve the integrity of the edge structure, improve gap size between the opposing portions and reduce overall weight of the luggage, resulting in a lighter luggage case with a strong frame structure. In addition, the various frame structures described herein makes it possible to create a clean appearance with no or minimal interruptions at the outer corners, thereby enhancing the structural integrity of the luggage case and reducing the chances of fraying or breakage. Moreover, by eliminating or reducing the need of wire beads and the process involved to form and fitting the wire beads, the direct securement of surrounding components to the frame by a common sewn or stitched attachment may significantly reduce the steps required to assemble the luggage case, thus increasing production efficiency. Furthermore, the frame structures as described herein enable design flexibility since various layers may be joined to the frame structure by one common sewing or stitching operation. Various layers may be added or eliminated without changing much of the assembly routine.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present invention will now be described by way of example only with reference to the following figures in which.

DETAILED DESCRIPTION

Described herein is a luggage frame structure for use in luggage items, such as soft side suitcases, hybrid suitcases, backpacks, briefcases, computer bags, or any luggage items that contain soft portions and may desire shape and/or structural reinforcement to the soft portions. The luggage item may include opposing housing portions enclosing a compartment, the opposing housing portions being separable in part by a closure mechanism, such as a zipper mechanism. The opposing housing portions used herein may refer to a front portion and a rear portion, such as the relatively flexible or soft panels used for soft side suitcases, or any two portions of the luggage item body separable by the closure mechanism, such as the zipped top opening of a backpack, duffle, computer bags, and so on.

Figures 1A, 1B, 1C:
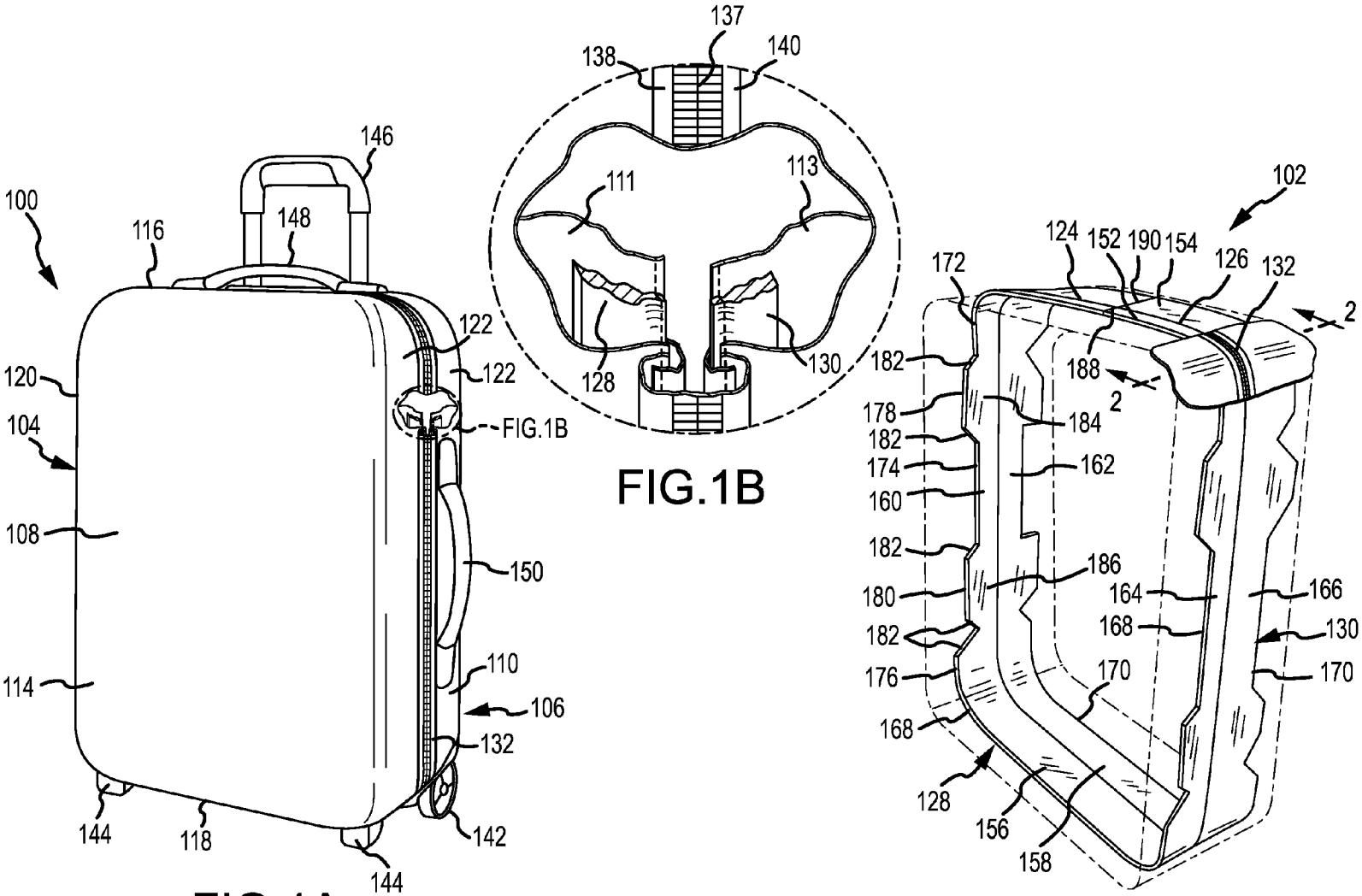
FIG. 1A is a front perspective view of a luggage case incorporating a frame structure according to a first example, a portion of the luggage case being cut away to illustrate the attachment of the various components of the luggage case to the frame structure.
FIG. 1B is an enlarged view of the portion of the luggage case being cut away shown in FIG. 1A.
FIG. 1C is a front perspective partial view of the luggage case shown in FIG. 1A, the luggage case panels being mostly shown in phantom lines to better illustrate the frame structure.

By way of example and without limitation, FIGS. 1A, 1B and 1C shows a luggage case 100 incorporating a frame structure 102 according to a first example. The outer surface of the luggage case 100 are shown in phantom lines to reveal the frame structure 102. Please note that although some of the phantom lines in FIG. 10 (and FIGS. 3A, 3B and 7 as will be described later) may appear at the intersections of adjacent sides (for example, the top and the front, the left and the bottom, and such) of the luggage case 100, these phantom lines may not necessarily indicate that the luggage case 100 includes lines of intersections or interruptions formed by its adjacent sides. Rather, the adjacent sides may be continuous, and may define a transition area there between with a smooth, curved, arcuate or rounded appearance.

In continuing reference to FIGS. 1A, 1B and 1C, the luggage case 100 may include outer or opposing front and rear portions 104, 106, forming in general a parallelepiped shape defining an interior compartment for receiving items. Each of the outer or opposing portions 104, 106 may include an outer cover 108, 110 defining an outer or exterior surface of the luggage case 100 that may be formed of relatively flexible and durable material, such as natural or man-made woven or non-woven fabrics, plastic sheets, leather or any type of material used to form soft side luggage pieces. The inner compartment of the luggage case 100 may include inner liners 111, 113, interior pockets, dividers that may divide the inner compartment into multiple sub-compartments, clips, hooks, hangers, clothes straps and so on.

Each of the outer portions 104, 106 may include a major face panel 114, a top panel 116, a bottom panel 118, a left panel 120 and a right panel 122. The top, bottom, left and right panels 116, 118, 120, 122 together define a peripheral edge (or rim), respectively, of the outer portions 104, 106. The peripheral edge is primarily defined by the outer peripheral edge 124, 126 of the respective front or rear frame members 128, 130 of the frame structure 102 as described below, to which the outer cover 104, 106, liner 111, 113, a closure mechanism 132, a hinge element and/or other layers or components may be directly connected by a common sewn or stitching attachment structure. This direct attachment of these components to the peripheral edge of the front and/or rear portions 104, 106 reduces the number of assembly steps, allows the luggage case 100 to be supported in its shape without the need of a wire bead structure, and lessens the weight of the frame and overall luggage case 100. These aspects of the invention are described in more detail below. Note that while the supplemental use of a wire or plastic reinforcement bead may provide additional strength, it is not required. It is contemplated that the outer portions 104, 106 may in some circumstances include opposing portions of a luggage case, such as a front shell and rear shell, as well as other configurations where shells are not implemented in the luggage case.

The hinge element may be made of fabric and secured between selected corresponding lengths of the peripheral edges of the outer portions 104, 106, also by sewing or stitching. Other types of hinge elements are contemplated, such as but not limited to a continuous piano hinge, or a pair of spaced-apart discrete hinges. The closure mechanism 132 may include a zipper mechanism 132. In some examples, the zipper mechanism 132 may include a zipper tape having a front and rear longitudinal edges 134, 136 separable by a zipper track 137 into a front half 138 and a rear half 140, at least one zipper slider associated with the zipper track 137 to seam and unseam the zipper track 137.

The luggage case 100 may include wheel assemblies 142 attached to the main housing compartment adjacent to the corners of the bottom panels 118 of the front and rear portions 104, 106 to assist a user in moving the luggage case 100 along a support surface. The luggage case 100 may include feet or other supports 144 positioned on one or more sides of the luggage case 100 to allow the luggage case 100 to be supported on, but spaced above, a support surface, such as the ground. The luggage case 100 may include a telescopic handle 146 to pull or push the luggage case 100 on its wheels 142, and one or more carry handles 148, 150 to lift or otherwise move the luggage case 100. The luggage case 100 may further include a security lock to restrict access to the inner compartment of the luggage case 100.

With reference to FIGS. 1A, 1B, 1C and 1D, the luggage case 100 may include a frame structure 102 positioned inside each of the outer covers 108, 110 of the front and rear portions 104, 106 of the luggage case 100. The frame structure 102 may be a honeycomb frame structure, and may include a front frame member 128 and a rear frame member 130. Each of the front and rear frame members 128, 130 may be configured to at least partially support and shape the front and rear portions 104, 106, respectively, and may be positioned along the peripheral edges of respective portions 104, 106. Each of the front and rear frame members 128, 130 may include a top portion 152, 154, a bottom portion 156, 158, a left portion 160, 162 and a right portion 164, 166 configured to support the top, bottom, left and right panels 116, 118, 120, 122 of the front and rear portions 104, 106 of the luggage case 100. The frame members 128, 130 bend around the corners formed between two adjacent portions of each frame member 128, 130 to form smooth, curved or arcuate shapes that both support the outer surface 108, 110 as well as provide a rounded finished appearance.

Each frame member 128, 130 may include an inner longitudinal (or peripheral) edge 168, 170 and an outer longitudinal (or peripheral) edge 124, 126, and define a frame width there-between. Accordingly, the frame member 128, 130 may include portions, such as top, bottom or side portions 152, 154, 156, 158, 160, 162, 164, 166 or segments 184, 186 thereof as described below that are planar along the frame width. The outer longitudinal edge 124, 126 of each frame member 128, 130, which in part forms the peripheral edges of the respective front and rear portions 104, 106 of the luggage case 100, may extend in a relatively linear manner. This outer longitudinal edge 124, 126 may be configured in a superimposed, overlapping, overlying or coextensive relationship with the peripheral edge of the associated front or rear portion 104, 106 of the luggage case 100.

The inner longitudinal edge 168, 170 of each frame member 128, 130 may extend in a straight line, curved line, angled segment (at right, acute, obtuse, and/or reverse angles) or a combination of these. The various types and directions of the extension of the inner longitudinal edge 168, 170 collectively define a frame profile having varying widths. Accordingly, the frame member 128, 130 may include a varying width along its longitudinal extension. Specifically, the frame member 128, 130 may include portions configured to be narrow for weight reduction considerations and portions configured to be wide to provide strength where needed, such as for support for attaching luggage parts, such as handles 146, 148, 150, wheels 142 and/or feet 144 and for load bearing considerations. Note that the outer longitudinal edge 124, 126 of each frame member 128, 130 may also have a profile if desired.

Figures 1D, 1E, 1F, 2A, 2B:
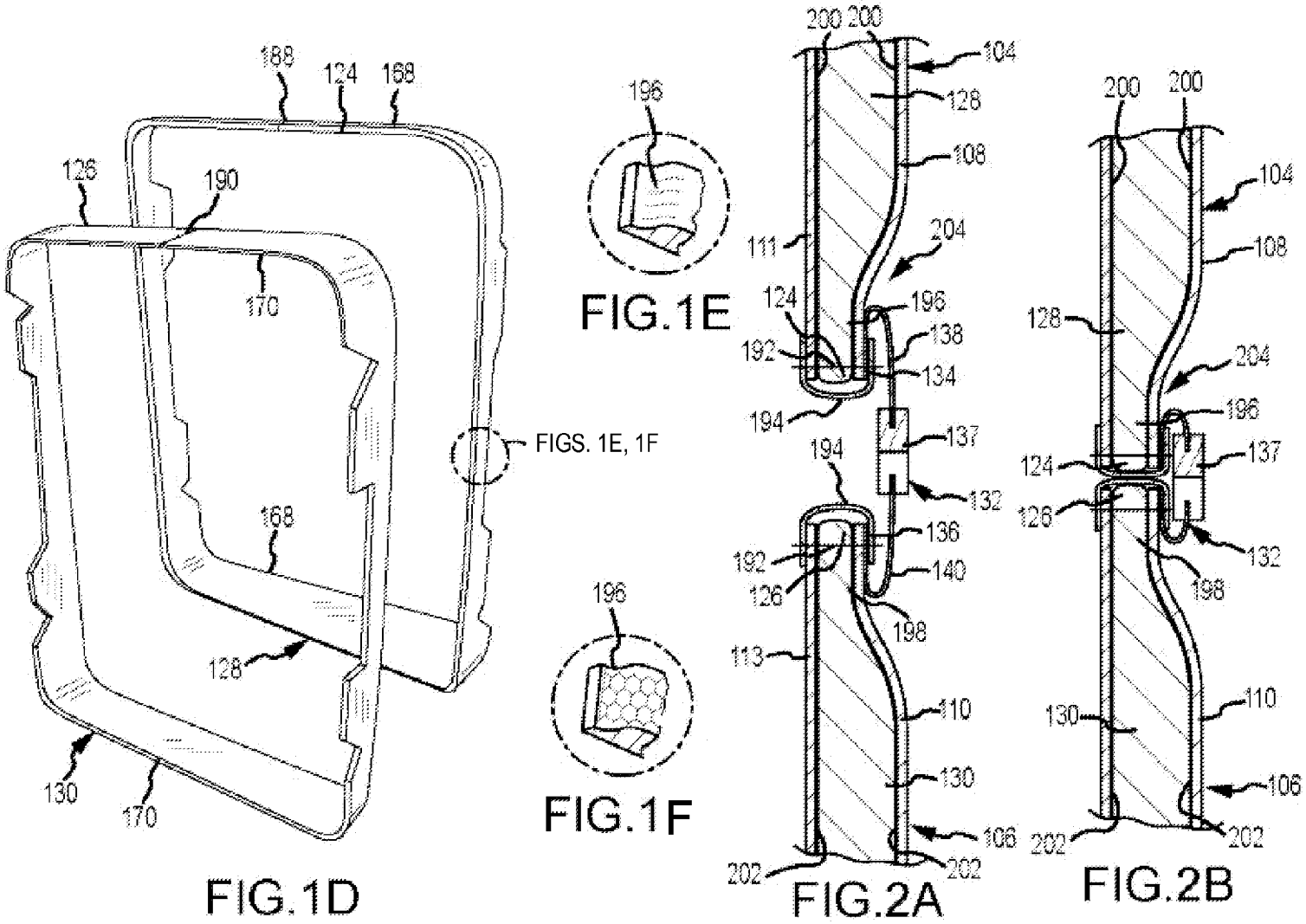
FIG. 1D is an exploded rear perspective view of the luggage frame structure shown in FIG. 1C.
FIG. 1E is a portion of the frame structure taken from FIG. 1D.
FIG. 1F is a portion of the frame structure taken from FIG. 1D, the portion having a honeycomb structure.
FIG. 2A is a representative cross section view of a side portion of the luggage case shown in FIG. 1A, viewed along line 2-2 in FIG. 1C.
FIG. 2B is a representative cross section view similar to that of FIG. 2A, incorporating a different closing mechanism.

As shown in the example of FIGS. 1C and 1D, each of the front and rear frame member 128, 130 may include a top portion 152, 154 and a bottom portion 156, 158 each formed of a constant width and a left and right portions 160, 162, 164, 166 each formed of a varying width along their respective longitudinal extensions. The bottom portion 156, 158 may be preferably configured to be relative wider than the other portions 152, 154, 160, 162, 164, 166 of the frame member 128, 130. The bottom portion 156, 158 may be positioned over the entirety or a substantial portion of each bottom panel 118 of the front or rear portion 104, 106 of the luggage case 100. Such configuration of the bottom portion 156, 158 of the frame member 128, 130 provides structural support for joining wheel assemblies 142 or feet 144 to the bottom 118 of the luggage case 100, and also provides a load-bearing surface for the items in the luggage case 100. Since the top, left and right panels 116, 120, 122 of the luggage case 100 serve less frequently as a load bearing surface compared to the bottom panels 118, the top, left and right portions 152, 154, 160, 162, 164, 166 of the frame members 128, 130 may be positioned to support the top, left and right panels 116, 120, 122 of the luggage case 100 only in the desired or necessary locations. As described below, this helps reduce the weight of the luggage case 100. Accordingly, the widths of top, left and right portions of the frame members 128, 130 may be much smaller than respective widths of the associated top, left and right panels, and may have varying widths along those panels.

With continuing reference to FIGS. 1C and 1D, the left and right portions 160, 162, 164, 166 of each frame member 128, 130 may further define a varying width. The left and right portions 160, 162, 164, 166 of the frame members 128, 130 may include portions of their respective inner longitudinal edges 168, 170 extending away from the outer peripheral edges 124, 126 of the respective left and right panels 120. Specifically, portions of the frame members 128, 130 to which handles and/or supports may be joined may extend further toward the major face panel 114 hence be wider than the other portions of the frame member 128, 130. Accordingly, the inner longitudinal edge 168, 170 of the left and right portions 160, 162, 164, 166 of the front frame member 128 may include a plurality of segments parallel to, or at angles with or curved with respect to, and spaced apart from the respective outer longitudinal edge 124, 126 at various dimensions.

Taking the left portion 160 of the front frame member 128 for example, the inner longitudinal edge 168 thereof may include a top segment 172, a middle segment 174, and a bottom segment 176. The top segment 172 may define a width similar to or the same as the width of the top portion 152 of the frame member 128 thereby forming a smooth, curved or arcuate transition at the top left corner of the frame member 128. Similarly, the bottom segment 176 may define a width similar to or the same as the width of bottom portion 156 of the frame member 128 thereby forming a smooth, curved or arcuate transition at the bottom left corner of the frame member 128. Such smooth transitions at the top and bottom corner regions of the frame member 128 support the outer cover 108 of the luggage case 100, provide a rounded finished appearance thereof, and facilitate even distribution of stress across the outer cover 108. The middle segment 174 may define a width smaller than the width of the bottom and/or top portions 172, 176 of the frame member 128 since the side panels 120 serve less frequently as a load bearing surface compared to the bottom and/top panels 116. The middle portion of the left side portion 160 of the front frame member 128 may include segments 178, 180 that define a larger width dimension. Such larger width dimensions yield a larger area 184, 186 for supporting and joining thereto the handles and/or supports of the luggage case 100 by fasteners, sewing, gluing, welding, bonding, adhering, stapling or any suitable connection method. As shown in the figures, the inner longitudinal edges 168, 170 of other portions of the front and rear frame members 128, 130, such as the left portion 162 of the rear frame member 130, the right portions 164, 166 of the front and rear frame members 128, 130, may also be configured with segments that may form wider or narrower regions of the frame member. The top and bottom portions 152, 154 may also have wider or narrow regions defining a varying width.

The various segments 172, 174, 176, 178 of the inner longitudinal edge 168, 170 may collectively define a stepped profile with substantially straight segments 182 connecting the ends of two adjacent segments for manufacturing simplicity. The connecting segments 182 may be substantially perpendicular to or formed at any suitable angle (right, acute, obtuse, and/or reverse) with the outer longitudinal edge 124. In some examples, the various segments 172, 174, 176, 178, 180, 182, including the connecting segments 182, of the inner longitudinal edge 168, 170 may form smooth and/or curved transition between adjacent segments. Although two relatively wider portions 184, 186 are shown and described herein along the side portions 160, 162, 164, 166 of the front and rear frame members 128, 130, more or less wider portions may be arranged for joining and supporting various luggage parts, depending on the luggage design. In some examples, not all side portions 160, 162, 164, 166 of a frame member 128, 130 may be formed with a varying width. Some side portions 160, 162, 164, 166 of the frame member 128, 130 may be formed with consistent width, preferably narrow to reduce weight.

Although the top and bottom portions 152, 154, 156, 158 of the front and rear frame members 128, 130 are shown formed with consistent width dimensions, they may be formed with varying width dimensions. The bottom portions 156, 158 of the frame members 128, 130 may include cutout to accommodate wheel housing for joining wheel assemblies 142. One of the top portions 152, 154 may include wider portions for joining a lifting handle 148. In some examples, both of the top portions 152, 154 may be formed with constant width with one being wider than the other for supporting the top panel 116 to which a lifting handle 148 may be joined.

Each of the front and rear frame members 128, 130 may be made of a materials that is rigid yet allows some flexibility and preferably lightweight, including but not limited to honeycomb board made of any suitable materials, such as plastic, metal or wood. The frame members 128, 130 may be formed by cutting a honeycomb board into strips to form elongated members with predetermined profiles. The honeycomb strips may then be bent into a frame structure, such as a closed or continuous loop (see FIGS. 1C and 1D) as described above, with two ends of the honeycomb strip joined together by fasteners, sewing, gluing, welding, bonding, adhering, stapling or any suitable connection method. The joint 188, 190 may be preferably positioned at the top portion 152, 154 of the frame member 128, 130 near a center thereof such that the frame member 128, 130 is symmetrical about a vertical plane through the connection joint 188, 190. Forming the joint 188, 190 at the top portion 152, 154 of the frame member 128, 130 also ensures that the bottom portion 156, 158 where the wheel assemblies 142 and/or feet 144 are joined to is continuous thus having better strength and load bearing properties.

With reference to FIGS. 2A and 2B, the attachment of the zipper mechanism 132, outer covers 108, 110, the frame members 128, 130, and/or the inner liners 111, 113 at the peripheral edges of the font and rear portions 104, 106 as noted above are described. As shown in FIG. 2A regarding the front frame member 128, the outer surface 108, zipper mechanism 132, and inner materials 111 of the luggage case 100 form a layered structure and are secured directly by a common sewn or stitched attachment 192 to the outer longitudinal edge 124 of the front frame member 128. A binding hem 194 may be included in the layered structure, as shown, to cover the free ends of these components to provide a finished appearance and reduce delaminating. The common sewn or stitched attachment 192 may include sewing or stitching connection, such as one or more lines of stitching joining various layers to the frame member. Sewing or stitching the various layers, such as outer covers, liners, closure mechanism and/or closure mechanism directly to the honeycomb frame structure enhance the structural integrity and strength of the luggage case.

In some examples, the more than one line of stitching may be configured to overlap or be adjacent to each other. In some examples, the more than one line of stitching may be configured to be offset by a distance and may or may not cross each other. In some examples, each of the one or more lines of stitching may be configured to join or secure together all the various layers of the layered structure. In some examples, one or more of the lines of stitching may be configured to join or secure together less than all the various layers of the layered structure. For example without limitation, one or more of the lines of stitching may be configured to selectively join or secure together two or more layers of the layered structure (e.g., the zipper mechanism 132, the outer covers 108, 110, the frame members 128, 130 and one leg of the binding 194 or any other suitable combination), and one or more of the lines of stitching may be configured to selectively join or secure together two or more different layers of the layered structure (e.g., the inner liners 111, 113, the frame member 128, 130 and the other leg of the binding 194 or any other suitable combination). Although each of the lines of stitching may be configured to join or secure together different layers of the layered structure, the various lines of stitching may still be considered as collectively defining a common sewn or stitched attachment 192 for joining or securing together the various layers of the layered structure. In some examples, the common sewn or stitched attachment may include continuous lengths of sewing or stitching along the entire periphery of the frame member. In some examples, the common sewn or stitched attachment may include discontinuous lengths or segments of sewing or stitching. In some examples, the common sewn or stitched attachment may include a combination of continuous lines of stitching along the entire periphery of the frame member and some discontinuous lengths or segments of sewing or stitching along portions of the periphery as additional reinforcements. In some examples, the common sewn or stitched attachment may be used in combination with many other suitable connection mechanisms, such as staples, fasteners, glue, adhesive, welding, bonding, etc. In some example, instead of using a common sewn or stitched attachment, the various layers may be joined by staples, fasteners, glue, adhesive, welding, bonding, etc., or any combination thereof.

The direct securement of these components to the outer longitudinal edge, such as stitching through the honeycomb frame improves the integrity of the edge structure, reduces weight, improves gap size between front and rear portions, and creates a clean appearance. Importantly, the direct securement of surrounding components to the frame may significantly reduce the steps required to assemble the luggage case as contrasted with conventional luggage making methods. Especially by eliminating the step of fitting multiple wire frame structures after the luggage panels are joined together, which is usually completed by a human operator, the direct securement of various component to the frame as described herein may be easily done automatically by machines. Thus, increased production efficiency can be achieved. Furthermore, the luggage construction method as described herein enables automation enhancement in the production process. This is because various layered structures may be aligned more easily by machines, or be stacked and cut to form an aligned edge easily by machines. Moreover, the structure and methods as described herein enable design flexibility since various layers may be added or eliminated without changing much of the assembly routine. Accordingly, the luggage structure and construction methods as described herein increase operational efficiency, and thus reduce production costs.

Remaining with FIG. 2A, in this sandwich structure, at least a portion of the edge 134 of the front half 138 of the zipper tape, the outer cover 108, and the inner liner 111, are positioned adjacent to the outer peripheral edge 124 of the front frame member 128 and form a layered structure. A binding hem 194 is positioned in a reverse "C" shape (relative to FIG. 2A) to receive the layered structure in the concave recess, with the legs extending over the outermost layer of the layered structure. A common sewn or stitched attachment 192, such as a line of stitching, is secured through the layered structure and the binding hem 194.

Similarly, the outer peripheral edge 126 of the rear frame member 130 and the edge portions of the inner liner 113, the outer cover 110, and the rear longitudinal edge portion 136 of the zipper mechanism 132 form a layered structure and may be received within a concave recess defined by the legs of another "C"-shaped binding hem 194. A common sewn or stitched attachment 192, such as a line of stitching, is secured through the layered structure and the binding hem 194. Other types of fasteners or securing techniques are contemplated, such as staples, rivets, adhesives, or the like. More or less layers may be stitched together. In some examples, the outer cover 108, the frame members 128, 130 and the zipper tape 138, 140 may be received within the recess of the binding hem 194, and the inner liner 111, 113 may not be received within the recess of the binding 194 or joined thereto through stitching. Additionally, the edge of the hinge element may be positioned within the layered structure in place of or in addition to another layer, such as the zipper tape 138, 140, in order to secure the hinge in the desired location along a length of the peripheral edge of the front and rear portions 104, 106.

As best shown in FIG. 2B, in some examples, the zipper mechanism 132 and the stitching location may be selected in a manner such that the front and rear outer portions 104, 106 may be brought into contact when the luggage case 100 is closed. In this contacting or abutting configuration, the front and rear frame members 128, 130 may form a continuous support layer underneath the zipper track 137 of the zipper mechanism 132 when the luggage case 100 is closed. Such continuous support for the zipper track 137 by the frame members 128, 130 makes it more difficult to penetrate the engaged zipper teeth 137 by a sharp object from the outside hence enhancing the security of the luggage case 100.

As also shown in FIGS. 1E, 2A and 2B, the frame member 128, 130 may preferably, but optionally, define a thinner peripheral edge portion 196, 198 where the different layers are joined together by stitching as described above. Such localized thinning may facilitate the stitching operation, and also result in the layered structure being generally flush with the level of the outer surface 108, 110 (see FIGS. 2A, 2B), as opposed to having a raised profile where the localized thinning is not utilized. In addition, if the localized thinning is created by reducing the thickness dimensions between the outer layers 200, 202 of each of the frame members 128, 130 at the outer peripheral edges 124, 126, such as shown in FIGS. 2A and 2B, the frame members 128, 130 may create a recessed channel 204, such as an annular recessed channel, when the luggage portions are joined together by the zipper mechanism 132. The recessed channel 204 may be configured in a manner such that the zipper teeth of the zipper track 137 may be positioned therein and be flush or below flush with the outer surface 108, 110 of the luggage case 100. Such configuration may reduce damage to the zipper mechanism 132 that may be caused by scuffs or abrasions, among other things.

The localized thinning may be accomplished by compressing the material of the frame in a manner that reduces the thickness in a lasting manner. Alternatively, the localized thinning may be manufactured into the frame material dimensions. The localized thinning may be utilized around the entire perimeter 124, 126 of the front and rear portions 104, 106, or it may be utilized only in selected locations on either one or both of the front and/or rear portions 104, 106. Where maximum strength is desired, it may be determined that not having a localized thinning feature is preferred. In one example, the localized thinning is located along a strip approximately 0.5 to 2 centimeters wide, or wider.

In some examples, the frame members 128, 130 may define a uniform thickness along its width dimension and not be thinned at the outer peripheral edges 124, 126. In some examples, the half zipper tapes 138, 140, the outer covers 108, 110, or the inner liners 111, 113 may fold around the peripheral edge portion 124, 126 of the frame members 128, 130 and attach thereto by stitching, thereby replacing the binding 194. In this example, the zipper tape 138, 140 may be stitched on top of or below the folded over-edge noted above.

The advantages of the luggage frame structure 102, specifically using planar peripheral frame members 128, 130 as described herein (whether with our without localized thinning) in comparison to conventionally frame structure, such as that shown in GB2339679, U.S. Pat. No. 3,962,010, U.S. Pat. No. 4,433,760, U.S. Pat. No. 5,529,156, U.S. Pat. No. 5,794,744, US2004/0079604, US2006/0249344, US2007/0045071 and CN2380081, are many. For instance, such luggage frame structure eliminates the need of wire beads and the process involved to form and fitting the wire beads. In contrast to the conventional way of fitting wire beads to the exterior of the outer covers of the luggage case, the outer covers 108, 110 as described herein extends over the outside of the planar frame members 128, 130. Accordingly, the frame structure 102 as described herein makes it possible to form a luggage case 100 with no or minimal interruptions at the outer corners, thereby enhancing the structural integrity of the luggage case 100 and reducing the chances of fraying or breakage. Furthermore, in contrast to the conventional multi-step luggage construction where planar frame boards, such as honeycomb boards, are fitted into pockets after assembly, the planar frame members 128, 130, the outer covers 108, 110, zipper mechanism 132, and/or inner liners 111, 113 are joined together in one step according to the luggage construction as described herein. Accordingly, constructing a luggage case using the method and the planar frame members as described herein simplify the assembly process and may result in a lighter luggage case with a strong frame structure.

Although not shown in FIGS. 1A, 1B, 1C and 1D, the frame structure 102 may further include structures that support and help create the three-dimensional shape of the luggage case 100. In some examples, such three-dimensional shape maintaining structures may be formed integrally with the frame members 128, 130. For example, the frame members 128, 130 may each include portions extending the entire width dimensions of the top, bottom, left and/or right panels 116, 118, 120, 122 of the opposing housing portions 104, 106 of the luggage 100. Such portions of the frame members 128, 130 may be provided near the corner regions of the frame members 128, 130 or along their lengths at any desirable locations. In some examples, additional component may be provided and operably coupled to the frame members 128, 130 to provide three-dimensional shape support to the luggage case 100, such as the examples as described below with respect to FIGS. 3A, 3B, 4, 5, 6, 7, 8A and 8B.

Figure 3B:
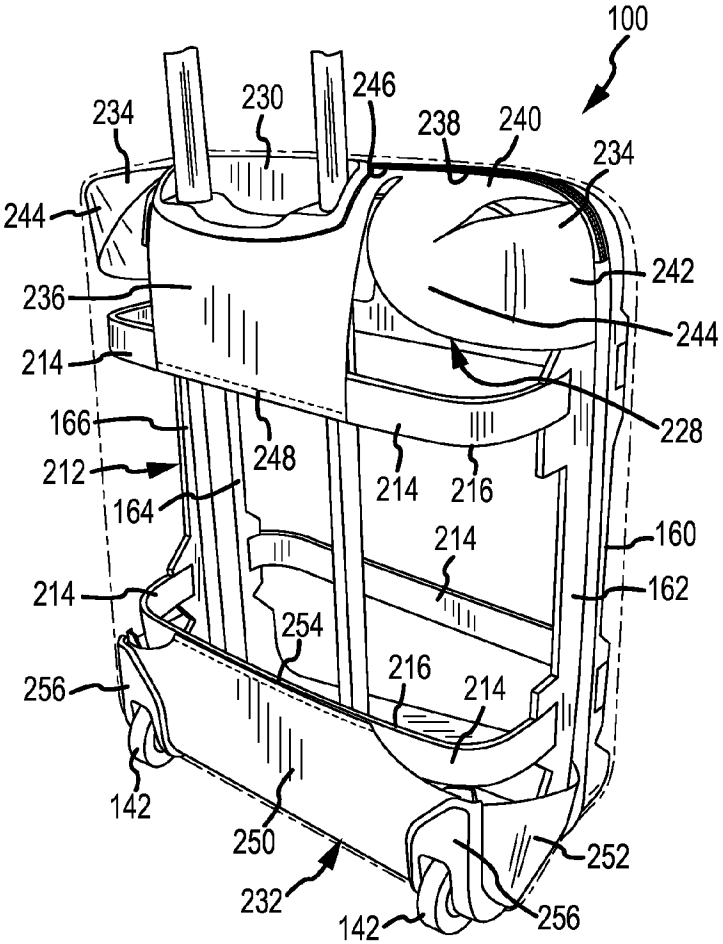
FIG. 3B is a rear perspective view of the luggage case shown in FIG. 3A.
Figure 3A:
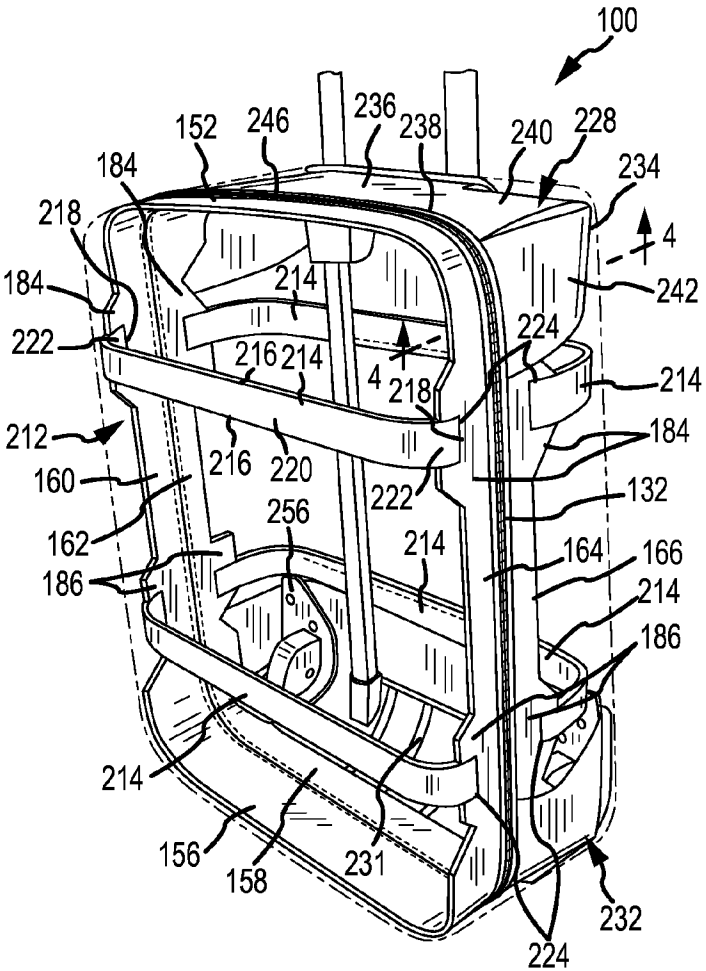
FIG. 3A is a front perspective view of a luggage case incorporating a frame structure according to a second example, with the luggage outer covers shown in phantom lines.
Figure 6:
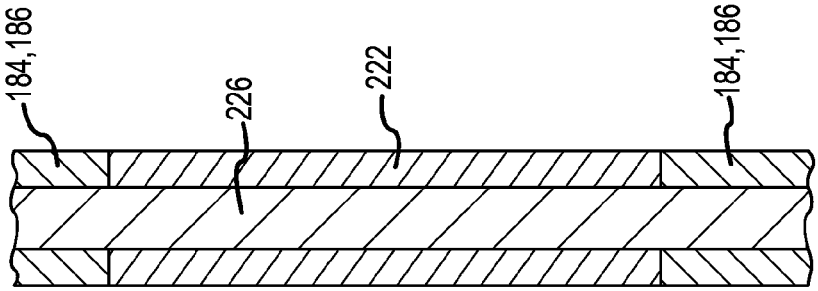
FIG. 6 is a representative cross section view of a side portion of the luggage frame structure shown in FIG. 5, viewed along line 6-6 in FIG. 5.

With references to FIGS. 3A, 3B, 4, 5 and 6, a luggage case 100 incorporating a second implementation of a frame structure 212 is described. The exterior surface 108, 110 of the luggage case 100 is shown in FIGS. 3A and 3B in phantom line to reveal the frame structure 212. The luggage case 100 may include a main housing compartment having opposing front and rear portions 104, 106 as noted above relative to FIGS. 1A, 1B, 1C, 2A and 2B. Similar to the frame structure 102 shown in FIGS. 1C and 1D, the luggage case 100 in this implementation may include a frame structure 212 as shape and structure reinforcements positioned inside the outer covers 108, 110 of the front and rear portions 104, 106 of the luggage case 100. The frame structure 212 may include a front frame member 128 and a rear frame member 130 similar to that described with reference to FIGS. 1C and 1D. Each of the front and rear frame members 128, 130 may include a top portion 152, 154, a bottom portion 156, 158, a left portion 160, 162, a right portion 164, 166 configured to support the top, bottom, left and right panels 116, 118, 120, 122 of the front and rear portions 104, 106 of the luggage case 100. One or more portions of the frame members 128, 130 may define a varying width along their respective lengths.

In continuing reference to FIGS. 3A, 3B, 5 and 6, the luggage frame structure 212 may further include one or more brace members 214 to support the major face panels 114 of the opposing portions 104, 106. Each of the brace members 214 may define in general a laterally extending elongated rectangular member having two longitudinal edges 216 and opposing ends 218. Each brace member 214 may be positioned adjacent a major face panel 114 of the front or rear portion 104, 106 of the luggage case 100, with one opposing end 218 joined to one of the side portions 160, 162, 164, 166 of the frame member 128, 130 associated with that panel 114, and the other opposing end 218 joined to the other of the side portions 160, 162, 164, 166 of the same frame member 128, 130. Accordingly, the brace member 214 may cross, and help create and maintain the shape of, the major face panel 114 along the longitudinal dimension of the brace member 214. In some examples, the brace member 214 may define in general a U-shape along its longitudinal edges 216, with a bottom portion 220 of the U-shape crossing a major face panel 114 and an opening defined by the frame members 128, 130 and two opposing side or end portions 222 of the U-shape each joined to a side portion 160, 162, 164, 166 of the corresponding frame member 128, 130. In some implementations, the bottom portion 220 of the U-shaped brace member 214 may be positioned in a plane different than the plane defined by the associated frame member 128, 130 so as to provide three-dimensional shape support to the luggage case 100 and to define a larger interior space of the luggage case 100.

Figure 5:
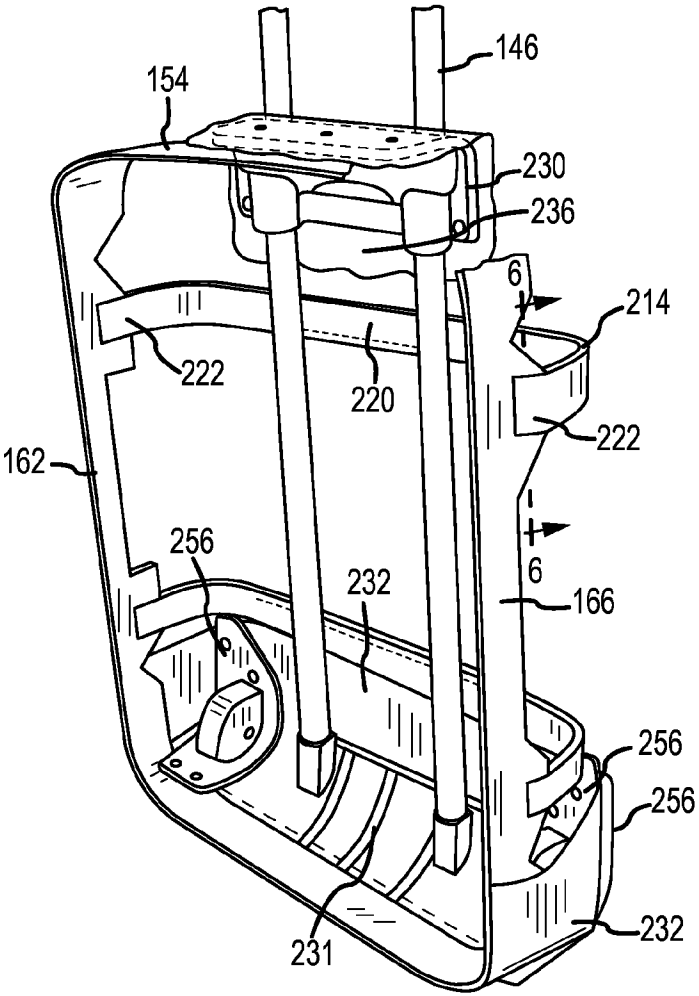
FIG. 5 is a front perspective view of the rear portion of the luggage case shown in FIG. 3A, with the front portion and the outer covers of the luggage case removed.

Each opposing end portion 222 of the brace member 214 may be joined to opposing side portions of a frame member 128, 130, and in this example at a location 184, 186 of the side portion where the width of the frame 128, 130 is enlarged. The end portion 222 may be slightly bent with respect to the middle portion 220 of the brace member 214 (forming the U-shape as described above) to be conveniently positioned adjacent the frame member portion 184, 186 to which it is attached. The opposing ends 222 may each be overlapped on the frame member 128, 130 and secured thereto by sewing, stapling, gluing, welding, bonding, adhering, fastening, or many other suitable techniques. Alternatively, as shown in FIGS. 3A, 3B and 5, a recess 224 may be formed in the wider segment 184, 186 of the side portion 160, 162, 164, 166 of the frame 128, 130 for receiving the end portion 222 of the brace member 214. The end portion 222 may then be joined to the frame member 128, 130 when received in the recess 224. A connecting pin 226 (shown in FIG. 6) may be positioned through the brace member 214 and adjacent portions 184, 186 of the frame member 128, 130. Such connecting pin 226 may also help maintain the brace member 214 and the adjacent honeycomb frame portion 184, 186 aligned in plane. Many other connecting mechanisms may be contemplated including, but not limited to, sewing, stapling, gluing, welding, bonding, adhering, and/or fasteners. It should be noted that the end portions 222 of the brace member 214 may be joined to many other portions of the frame member 128, 130. In some examples, the end portions 222 of the brace member 214 may be joined to a top portion 152, 154 and a bottom portion 156, 158, or any two portions of the frame member 128, 130, such as a top/bottom portion 152, 154, 156, 158 and a side portion 160, 162, 164, 166. Although it is shown that the brace member 214 may cross the major face panel 114 in a substantially horizontal direction, the brace member 214 may be arranged to cross the major face panel 114 vertically, diagonally or in any suitably direction. In some examples, only one of or both of the front portion 104 and the rear portion 106 may be configured with one or more brace members 214. When multiple brace members 214 are arranged at the front or rear portions 104, 106, the brace members 214 may be arranged in a parallel relationship with each other (see FIGS. 3A, 3B and 5), or not in a parallel relationship, such as crossing each other at right angles or suitable angles. Although a rectilinear shape of the brace member 214 is described herein as an example, the brace member 214 may be made of any suitable shapes. The brace members 214 may be formed with substantially straight edges or curvy edges. The brace members 214 may be formed with constant width or may be formed with a varying width. Additionally, the brace members 214 may overlap one another adjacent the major face 114, or may be made of one integral piece or several pieces connected together. Please note that the brace members 214 may be used for many different types of luggage incorporating many different frame structures and not be limited to be used in combination with the frame members 128, 130 as described herein. The brace members 214 may be coupled to the luggage case for supporting the luggage panels in many suitably ways, including but not limited to, joining the ends of the brace members 214 to a frame of the luggage case by stitching, fasteners, gluing, welding, bonding, adhering, stapling or any suitable connection method, positioning the brace members 214 in a pocket formed by the outer cover and/or the inner liners of the luggage case, and so on.

In continuing reference to FIGS. 3A and 3B, the luggage case 100 may further include additional structural members to help to retain the shape of the luggage case 100 and to provide structural support for joining one or more of wheel assemblies 142, kick plates and/or telescopic handles 146. The luggage case 100 may include an upper structural member 228 positioned adjacent the top of the rear portion 106 where the telescopic handle bezel 230 may be arranged. A lower structural member 232 may be positioned adjacent the bottom of the rear portion 106 where the wheel assemblies 142 and/or a kick plate 231 may be arranged. The upper structural member 228 may take the form of structural panels that define three sub-portions: two corner portions 234 and a middle portion 236 sharing a common peripheral edge 238 with the two corner portions 234, the common peripheral edge 238 being joined to the peripheral edge 126 of the rear frame member 130 as described below. Each of the two corner portions 234 may be formed from in general a bent structural panel, such as a polypropylene sheet. By folding a portion of the panel so that two inner edges of the panel are adjacent, the panel is formed into a three dimensional corner shape, with one part 240 of the bent panel conforming to the surface shape of the top panel 116 of the rear portion 106, the another part 242 of the panel conforming to the surface shape of one side panel 120, 122 of the rear portion 106, and a third part 244 of the panel conforming to the major face 114 of the rear portion 106. The terminal ends of the panel may form portions of the common peripheral edge 238 of the upper structural member 228, and may be joined to the peripheral edges of the top and side panels 116, 120, 122. Corner portions 234 formed from many other suitable shapes using many other suitable method may be contemplated.

Figure 4:
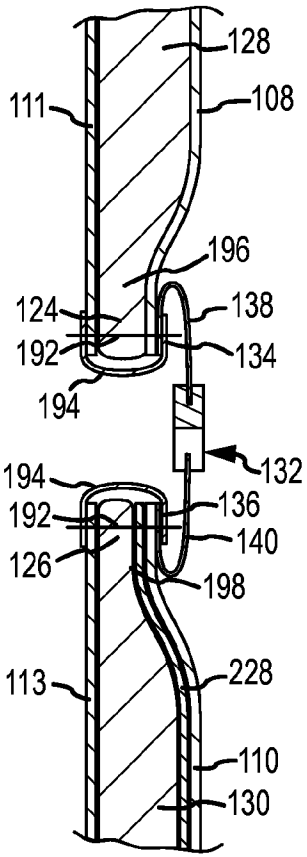
FIG. 4 is a representative cross section view of a side portion of the luggage case shown in FIG. 3A, viewed along line 4-4 in FIG. 3A.

Referring to FIG. 4, the edge portions of the structural members 228, 232, the outer covers 108, 110, the zipper mechanism 132 and/or inner liners 111, 113, for instance as shown in FIGS. 3A and 3B, may be joined directly to the frame members 128, 130 by sewing or stitching in a manner similar to that described above with respect to the example of FIGS. 1A, 1B, 1C, 2A and 2B. Regarding the rear frame member 130, at least a portion of the edge 136 of the rear half 140 of the zipper tape, the outer cover 110, the structural member 228, and the inner liner 113 are positioned adjacent to the outer peripheral edge 126 of the rear frame member 130 and form a layered structure. A C-shaped binding hem 194 is configured to receive the layered structure in its concave recess, with the legs of the C shape extending over the outermost layer of the layered structure. A common sewn or stitched attachment 192, such as a line of stitching, is secured through the layered structure and the binding hem 194. Other types of fasteners or securing techniques are contemplated, such as staples, adhesives, or the like. More or less layers may be received in the recess of the binding hem 194 and stitched together. As noted above, the frame members 128, 130 may optionally define a thinner peripheral edge portion 196, 198 to facilitate the stitching of the various layers. In some examples, the half zipper tapes 138, 140, outer covers 108, 110, or the inner liners 110, 113 may wrap around the peripheral edge portion of the frame members 128, 130 to form a recess similar to that formed by the bindings 194 to replace the bindings 194.

Referring back to FIGS. 3A and 3B, the middle portion 236 of the upper structural member 228 on the rear portion 106 of the luggage case 100 may define in general a rectilinear, trapezoid or other suitable shape conforming to a middle portion of the top panel 116 and a top middle portion of the major face 114 of the luggage case 100. The middle portion 236 of the upper structural member 228 may surround or incorporate the telescopic handle bezel 230. The top edge 246 of the middle portion 236 may be joined to the peripheral edge of the middle portion of top panel 116 by sewing or stitching in a manner similar to that described above with respect to the corner portions 234 of the upper structural member 228. As also explained above with respect to the first implementation, the luggage construction methods as described herein provide the design flexibility of adding or removing layers for making the luggage (in this example, adding additional layer of structural member material) without modifying the production facility. Accordingly, the top edge 246 of the middle portion 236 of upper structural member 228 can be simply aligned with the layered structure of the outer cover 110, frame member 130, inner liners 113, and sewn to the layered structure, binding hem 194, and the zipper tape edge portions 136 through the common sewn or stitched attachment. The bottom edge 248 of the middle portion 236 may be joined to an upper brace member 214 by fasteners, sewing, gluing, welding, bonding, adhering, stapling or any suitable connection method. The middle portion 236 may be preferably joined to the outer surface of the brace member 214 near the bottom longitudinal edge 216 of the brace member 214. Other suitable joining location may be chosen.

The middle portion 236 and two corner portions 234 of the upper structural member 228 may be formed as separate pieces or may be formed as an integral piece. The middle portion 236 and the two corner portions 234 may form at least an undivided, uniform piece where the top panel 116 is formed (see FIG. 3A) for better structural integrity.

The lower structural member 232 may be formed in a similar manner to the upper structural member 228, except that the middle portion 250 of the lower structural member 232 and the corner portions 252 may preferably form an undivided and uniform piece along the lower portion of the major face 114 of the luggage case 100. The top edge 254 of the middle portion 250 of the lower structural member 232 may be joined to an outer surface of a lower brace member 214 at its upper longitudinal edge 216 by fasteners, sewing, gluing, welding, bonding, adhering, stapling or any suitable connection method. The bottom edge of the middle portion 250 and the edges of the corner portions 252 may be joined to the peripheral edge of the bottom and side panels 118, 120, 122.

As best shown in FIGS. 3B and 5, a telescopic handle bezel 230 may be joined to the upper structural member 228. The inner and outer wheel housings 256 of the wheel assemblies 142 may be joined to the lower structural member 232 as well as the bottom portion 156, 158 of the rear frame member 130. A kick plate 231 may also be joined to the lower structural member 232 for receiving bottom ends of the telescopic handle 146. Method for joining the telescopic handle bezel 230, inner and outer wheel housings 256 of wheel assembly 142, the kick plate 231 and another suitable parts to the structural panel 232 and/or the frame member 130 may include fasteners, sewing, gluing, welding, bonding, adhering, stapling or any suitable connection method.

Figure 8B:
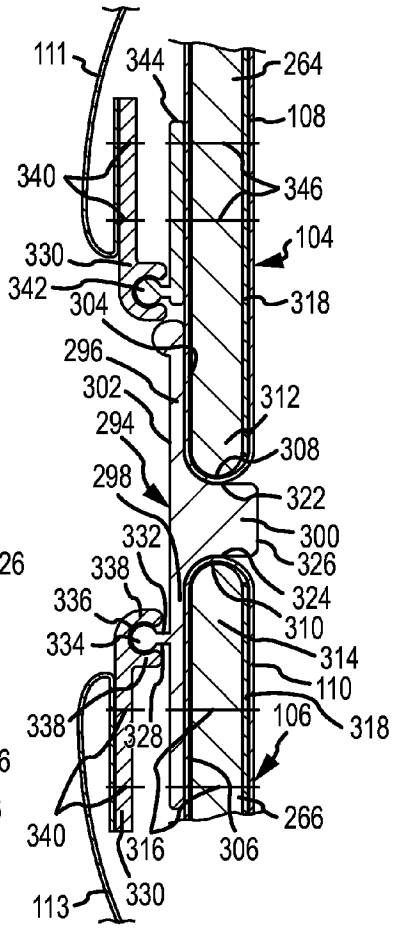
FIG. 8B is a representative cross section view of a side portion of the luggage case shown in FIG. 7, viewed along line 8B-8B in FIG. 7.
Figure 8A:
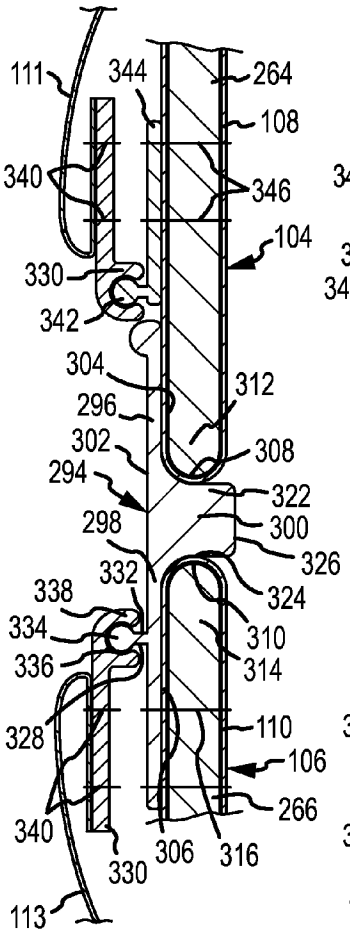
FIG. 8A is a representative cross section view of a side portion of the luggage case shown in FIG. 7, viewed along line 8A-8A in FIG. 7.
Figure 7:
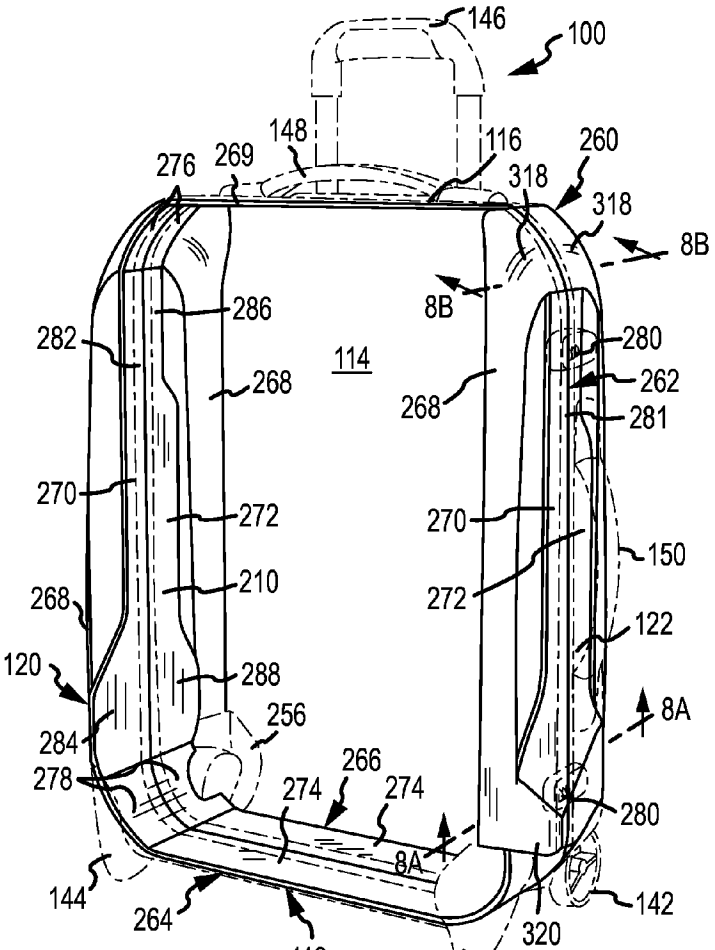
FIG. 7 is a front perspective view of a luggage case incorporating a frame structure according a third example, with the other components of the luggage case shown in phantom lines.

Referring to FIGS. 7, 8A and 8B, a luggage case 100 incorporating a third example of frame structure 260 is described. In FIG. 7, the outer covers 108, 110, luggage handles 146, 148, 150, wheel assemblies 142, support feet 144, luggage closure mechanism 262 and the hinge joining the opposing housings of the luggage case 100 are shown in phantom lines to better illustrate the frame structure 260. The frame structure 260 may include a front frame member 264 and a rear frame member 266, similar to those described above with respect to FIGS. 1C and 1D, and FIG. 4. The frame structure 260 may further optionally include structural columnar members 268 arranged at the intersections of the major face 114 and side panels 120, 122 of the front and rear portions 104, 106 to provide three dimensional shape support for the luggage case 100. Each of the front and rear frame members 264, 266 may include a top element 269, two opposing side elements 270, 272 and a bottom element 274, and transitioning regions 276, 278 joining two adjacent elements of the frame member 264, 266 and forming a smooth transition there between. The opposing top and bottom elements 269, 274 may be formed with constant width dimensions. The side elements 270, 272 may include a varying widths as described above. The luggage case 100 may include locks or latches 280 (see FIG. 7) positioned at one or more of the side, top or bottom panels 116, 118, 120, 122 to keep the opposing housing portions in a close, engaged configuration.

In continuing reference to FIG. 7 with respect to the front frame member 264, one or both of the side elements 270 thereof may include a narrower upper portion 282 defining a width similar to the top element 269 and the transitioning region 276 there between and a wider lower portion 284 defining a width similar to the bottom element 274 and the transitioning region 278 there between. A substantial length of the top element 269 may be narrow. A substantial length 282 of the side element 270 may be narrow too. Only a relatively short length 284 of side element 270 may be relatively wide all combining to create a lightweight frame structure 260.

With respect to the rear frame member 266, one or both of the opposing side elements 272 thereof may include a narrower upper portion 286, a wider lower portion 288 and a middle portion 290 formed with a third width dimension in between the width dimensions of the upper and lower portions 286, 288. The middle portion 290 may provide structural support for joining a carrying handle 150 to the luggage case 100. Although both side elements 272 of the rear frame member 266 are shown including middle portions 290 with a third width dimension for forming simplicity, one side element 272 may be formed without such middle portion 290 and may be formed similar to the side elements 270 of the front frame member 264.

Depending on the specific structures joined to the frame member 264, 266, the frame member 264, 266 may further include cutout to accommodate such structures. In some examples, the transitioning regions joining the side elements 272 and the bottom element 274 of the rear frame member 266 may include cutout 292 forming a slot for the wheel housings 256.

In contrast to the luggage case 100 of previous examples in which a zipper mechanism 132 is used as a closure mechanism, the luggage case 100 shown in FIGS. 7, 8A and 8B use a closure mechanism 262 including discrete mechanical latch mechanisms 280 and a peripheral engagement structure 281. The periphery 308, 310 of the front and rear portions 104, 106 of the luggage case 100 are thus held in abutment by the latch mechanism 280 when engaged. The peripheral engagement structure 281 (as described below) is configured between the abutted peripheral edges 308, 310 to form a closure therealong. Each of the latch mechanisms 280 may include a pair of engagement members configured to operably engage and disengage. Each of the pair of the engagement members may be mounted on respective one of the front and rear portions 104, 106 adjacent the peripheral edge 308, 310 and may be releasably actuable by a user to allow luggage case 100 to open up. Although two latch mechanisms 280 are shown positioned along one side panel 122 of each opposing portion 104, 106, more or less latch mechanisms 280 may be used. In some examples, single latch mechanism 280 may be used and positioned near a center of the side panels 122. In some examples, one or more latch mechanisms 280 may also be provided along the top and/or bottom panels 116, 118 of the opposing portions 104, 106.

Where discrete latch mechanisms 280 are used to secure the luggage case 100 in a closed configuration, the peripheral engagement structure 281 is different from the zipper mechanism 132 described above. The peripheral engagement structure 281 in this instance may be stitched to the periphery 310 of one of the opposing housing portions 106 as described below, and may engage or abut the periphery 308 of the other one of the opposing housing portions 106 when the luggage case 100 is closed. The peripheral engagement structure 281 may include an elongated member 294 having a generally T-shaped cross section. The elongated member 294 may extend along the periphery 308, 310 of one of the opposing housings 104, 106, such as from adjacent one end of a hinge element to adjacent the other end of the hinge element. In some examples, the elongated member 294 may run along the entire peripheral edge 308, 310 of the opposing housing portions 104, 106, or only along select portions of the peripheral edge 308, 310. When the luggage case 100 is closed, the horizontal extensions (with respect to FIGS. 8A and 8B), or two arms 296, 298 of the T-shape, are in an overlying relationship with the interior surface of the opposing portions 104, 106, and the vertical extension, or the trunk 300 of the T-shape 294 is in an abutting relationship with the peripheral edges 308, 310 of the opposing portions 104, 106 as described below.

With reference to FIGS. 8A and 8B, one arm 298 of the T shape 294 may be anchored to one of the opposing portions, such as the rear portion 106 as shown in FIGS. 8A and 8B, when the luggage case 100 is closed. The other arm 296 of the T shape 294 may extend to a free end for engagement with the peripheral rim 308 of the other opposing portion, in this example, the front portion 104, when the luggage case 100 is closed. The trunk 300 of the T shape 294, in this configuration being relatively shorter than the arms 296, 298, is received between the opposing peripheral rims 308, 310 when closed. The opposing peripheral rims 308, 310 abut, and may compress, the trunk 300 of the elongated member 294 when held closed by the latches 280. The arms 296, 298 of the T-shaped elongated member 294 may collectively define an inner surface 302 facing the inner compartment of the luggage case 100 and two outer surfaces 304, 306 facing the inner surfaces of the frame members 264, 266 when closed. One of the outer surface 306 may overlap and be attached to the inner surface of one of the frame members 266 thereby securing the elongated member 294 to the frame member 266 adjacent the peripheral rim 310 thereof. The other one of the outer surfaces 304 may be configured to temporally overlap the inner surface of the one of the frame members 264 adjacent the peripheral rim 308 thereof when the luggage is closed. When the luggage case 100 is in a closed configuration, the overlapping configuration between the arms 296, 298 of the T shape 294 and the rims 308, 310 of the opposing portions 104, 106 reduces the relative movement between the front and rear opposing portions 104, 106 thereby improving overall stability of the luggage case 100.

As noted above, the elongated member 294 is secured adjacent the peripheral rim 308, 310 of one of the front or rear portions 104, 106 of the luggage case 100. As shown in FIGS. 8A and 8B, the elongated member 294 is secured to the select outer peripheral edge 314 of the frame member 266, along with the associated outer cover 110. The peripheral portion of the outer covers 110 may fold around the peripheral edge 314 of the frame member 266 together forming a three-layered layered structure adjacent the peripheral rim 314 of the frame member 266. The elongated member 294 may be joined to the three-layered layered structure defined by the frame member 266 and the peripheral portions of the outer cover 110 to the interior and exterior of the frame member 266 by a common sewn or stitched attachment, such as lines of stitching 316. In some example, the stitching 316 may not go through the outer cover portion 110 to the exterior of the frame member 266 so as to form a stitch-free appearance of the luggage case 100. In some examples, instead of stitching 316, the three-layered layered structure and the elongated member 294 may be joined together through adhesive, fasteners, gluing, welding, bonding, stapling, and many other suitable connecting mechanisms. Regarding the other arm 296 of the T shape 294 which is not joined to a frame member 264, 266 by stitching, it may bend inward slightly toward the inner compartment of the luggage case 100 such that the elongated member 294 will not interfere with the opposing luggage portion 104 when the opposing luggage portion 104 is brought closer to close the luggage case 100.

With reference to FIGS. 8A and 8B, the luggage case 100 may include columnar elements 268 to provide three-dimensional shape and support. Each columnar element 268 may include an upper end 318 and a lower end 320 sandwiched between the exterior of the frame member 264, 266 and the outer cover 108, 110. The peripheral edge of the upper end 318 may be configured to be in alignment with the outer peripheral edge 312, 314 of the transitioning region 276 joining a top and a side elements 269, 270, 272 of the frame member 264, 266 such that a layered structure of the upper end 318, frame member 264, 266 and outer cover 108, 110 may be formed adjacent the peripheral rim 312, 314 and secured thereto by the same stitching operation for joining the outer cover 108, 110, the frame member 264, 266, and one arm 298 of the elongated member 294 as described above. The lower end 320 of the columnar elements 268 may be shaped with a peripheral edge in alignment with the outer peripheral edge 312, 314 of the frame member 264, 266 and joined thereto by a common sewn or stitched attachment. In some examples, the lower end 320 may be joined to a support assembly or the wheel housing 256 of a wheel assembly 142 through sewing, stitching, adhesive, fasteners, gluing, welding, bonding, stapling, and many other suitable connecting mechanisms. In some examples, the lower end 320 of the columnar elements 268 may be configured as a free end and may not be joined to the frame member 264, 266 or other structure.

Further referring to FIGS. 8A and 8B, the elongated member 294 may include a trunk 300 of the T shape 294 extending the entirety or at least a portion of the length of the elongated member 294. The trunk 300 may define two side surfaces 322, 324 and a raised surface 326 between the two side surfaces 322, 324. One of the side surfaces 324 may be in an abutting relationship with the peripheral rim 310 of one of the opposing portions 106 to which the elongated member 294 is attached. The other of the side surfaces 322 may be configured to be in an abutting relationship with the peripheral rim 308 of the other one of the opposing portions 104 when the luggage case 100 is in a closed configuration. The abutting configuration between the trunk 300 and the peripheral rims 308, 310 of the opposing portions 104, 106, as well as the overlying configuration between the arms 296, 298 and the adjacent rims 308, 310 as noted above, protects the items inside the inner compartment of the luggage case 100 from external contaminants, such as dust or even liquid spills. The trunk 300 may be configured to be of a height similar to the thickness of the frame members 264, 266 such that the elongated member 294 may be flush with the outer surface of the adjacent luggage panels thereby forming a smooth outer surface of the luggage case 100.

With continuing reference to FIGS. 8A and 8B, the inner surface 302 of the elongated member 294 may include a protruding element 328 for engaging a trim element 330 of the inner liner 113 of the luggage case 100 as described below. Preferably the protruding element 328 may be positioned at the inner surface 302 of the elongated member 294 between the stitches 316 joining the elongated member 294 to the frame member 266 and the peripheral edge 314 of that frame member 266 such that the joining stitches 316 will be covered and protected by the inner liner 113. The protruding element 328 may include a neck portion 332 and a head portion 334 raised by the neck portion 332 from the inner surface 302 of the elongated member 294. The head portion 334 may define in general a spherical profile with a diameter larger than the width of the neck portion 332. The head portion 334 may be configured to be removably received in, such as by snap-fit, in a groove 336 formed at an end of the trim element 330. The groove 336 may define a concave inner surface complementary to a portion of the outer surface of the head portion 334 of the protruding element 328. In some examples, the groove 336 of the trim element 330 may additionally and optionally define an opening smaller than the diameter of the head portion 334 but have a depth larger than the radius of the head portion 334. The head portion 334 may be fitted through the opening into the groove 336 by temporally and elastically deforming the opening and be held in the groove 336 by a friction fit. In some examples where the liner 113 is not intended to be removable, the head portion 334 may be additionally or optionally held in place by fasteners, adhesive, bonding, welding and so on.

Further referring to FIGS. 8A and 8B, the trim element 330 may define in general a strip having a length extending along the peripheral edge 312, 314 of the frame member 264, 266 and may be coextensive with the elongated member 294. The trim element 330 may include two protrusions 338 formed at the surface facing the elongated member 294 and adjacent to one of its longitudinal edges that is closer to the outer periphery edge 312, 314 of the frame member 264, 266. The two protrusions 338 define the groove 336 for engaging the protruding element 328 of the elongated member 294 as described above.

To joined the inner liner 111, 113 to the trim element 330, the edge portion of the inner liner 111, 113 may form a fold and align with the surface of the trim element 330 facing the inner compartment of the luggage case 100. The folded edge portion may be joined to the planar portion of the trim element 330 by stitching or sewing 340. Many other suitable connection mechanisms including, but not limited to, fasteners, gluing, welding, bonding, adhering, stapling may be used. Please note that although lines of stitches 316 for joining the outer cover 110 and the elongated member 294 to the frame member 266 are shown as separate stitches from lines of stitches 340 for joining the liner 113 to the trim element 330, they may still be considered as a common sewn or stitched attachment for joining various components to the peripheral rims of the frame member and/or luggage case. In some implementations, the outer cover 110, liner 113, elongated member 294, and/or trim element 330 may be joined to the frame member 266 by one or more continuous lines of stitching similar to the common sewn or stitched attachment as described with reference to the first and second luggage frame implementations.

Similarly, the inner liner 111 of the other half 104 of the luggage case 100 may also be configured with a similar trim element 330 for engaging the inner liner 111 to the frame member 264 associated with the other half 104 of the luggage case 100. Instead of engaging a protruding element of the elongated element 294, the groove 336 of the trim element 330 may engage a similar protruding element 342 of a different connecting member 344 joined to the frame 264. The connecting member 344 may take the form of a strip that runs along the inner surface of the frame member 264 and may be coextensive with the elongated member 294. The connecting member 344 may define a planar body having an outer surface facing the inner surface of the frame member 266 and an inner surface facing the inner compartment of the luggage case 100. The planar body 344 may be joined to the layered structure of the frame member 264 and the associated outer cover 108 by stitching or sewing 346. Many other suitable connection mechanisms including, but not limited to, fasteners, gluing, welding, bonding, adhering, stapling may be used. The protruding element 342, provided at the inner surface of the connecting member, may be preferably positioned along the peripheral edge of the connecting member closer to the outer peripheral edge 312 of the frame member 264 such that the stitches 346 for joining the connecting member 344, the frame member 264 and the out cover 108 may be covered and protected by the inner liner 111.

Although trim elements 330 are described herein for releasably engaging the liners 111, 113 to the frame members 264, 266, in some examples, such trim elements 330 may be not required. The liners 111, 113 may be stitched or sewn to the frame member 264, 266 directly such that the trim elements 330, connecting member 344, the protruding element 328 on the surface of the elongated member 294 as shown in FIGS. 8A and 8B may all be omitted.

It is contemplated that although a combination of an elongated member 294 with a T-shaped cross section and discrete latch mechanisms 280 are shown in FIGS. 7, 8A and 8B as the engagement structure 281, the luggage case 100 may incorporate a combination of the elongated member 294 with the T-shaped cross section and a zipper mechanism without using the mechanical latches 280. The opposing longitudinal edges of the zipper mechanism may be joined to respective front and rear frame members 264, 266 at either the exterior surfaces or the interior surfaces thereof. The zipper mechanism may be positioned to the exterior of and coextensive with the elongated member 294. When the luggage is closed, the zipper track or the engaged zipper teeth of the zipper mechanism may overlie, overlap or superimpose at least a portion of elongated member 294. This overlying, overlapping, superimposed or coextensive configuration between the zipper track and the elongated member 294 makes it more difficult to penetrate the engaged zipper teeth using a sharp object from the outside as the elongated member 294 provides support against the inside of the zipper teeth.

The connecting member 344, trim element 330 and the elongated member 294 as described herein may be formed as plastic extrusions using materials including, but not limited to, polyethylene (PE), polypropylene (PP), polyvinyl chloride (PVC), acrylonitrile butadiene styrene (ABS), and carbonate (PC). The frame members 128, 130, 264, 266 described herein may be formed using materials having a honeycomb structure or the like. Please note that the term honeycomb structure used herein includes, for example without limitation, a sheet structure having opposing outer layers and internal structure that defines the geometry of a honeycomb or the like. It also includes any structures that may not necessarily have the geometry of a honeycomb or the like, but may allow less amount of material to be used to reduce the weight of the structures while still maintaining the strength of the structures, for example without limitation, out-of-plane compression or shear properties of the structures, at a desired level. The additional and optional structural members 228, 232, 268 may be formed using materials such as a polypropylene ("PP") or polyethylene ("PE") sheet. The outer covers 108, 110 of the luggage cases herein may be formed using a relatively durable, and relatively soft or non-rigid or flexible material, such as natural or man-made woven or non-woven fabrics, or natural materials, such as leather, and so on. The inner liners 111, 113 of the luggage case may be formed using a less durable material as compared to the outer cover and relatively soft or non-rigid or flexible material such as nylon or polyester fabric.

Although a soft side luggage case is described herein as examples, the various frame structures as described herein may be incorporated to hybrid suitcases, backpacks, briefcases, computer bags, or any luggage items that contain a soft portion and may desire shape and/or structure reinforcement.

It is also contemplated that only one of the front or rear opposing portions of the luggage case may incorporate a frame member and/or the various structural elements described herein, while the other one of the front or rear opposing portions may not incorporate the frame member and/or the structural elements. In some implementations, the front opposing portion may take the form of a door or panel flap, thus not requiring a frame member as described herein or the structural elements for three dimension shape support.

It should be noted that all directional and/or dimensional references (e.g., upper, lower, upward, downward, left, right, leftward, rightward, top, bottom, above, below, front, back, rear, forward, backward, rearward, inner, outer, inward, outward, vertical, horizontal, clockwise, counterclockwise, length, width, height, depth, and relative orientation) are only used for identification purposes to aid the reader's understanding of the implementations of the disclosed invention(s), and do not create limitations, particularly as to the position, orientation, use relative size or geometry of the invention(s) unless specifically set forth in the claims.

Connection references (e.g., attached, coupled, connected, joined, and the like) are to be construed broadly and may include intermediate members between a connection of elements and relative movement between elements. As such, connection references do not necessarily infer that two elements are directly connected and in a fixed relation to each other.

In some instances, components are described with reference to "ends" having a particular characteristic and/or being connected with another part. However, those skilled in the art will recognize that the disclosed invention(s) is not limited to components that terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made that are within the scope of the appended claims.

The invention claimed is:

1. A luggage item comprising:

first and second outer portions defining an inner compartment of the luggage item;

at least one of the first outer portion or the second outer portion including a frame structure, at least one panel, and a relatively flexible cover member;

a closing mechanism operably engaging a peripheral edge of each of the first and second outer portions and configured to selectively open and close the luggage item;

the frame structure comprising a first frame member;

the first frame member forming at least a portion of the peripheral edge of the at least one of the first outer portion or the second outer portion;

the first frame member defining a varying width dimension extending in a direction away from the peripheral edge; and the relatively flexible cover member and the closing mechanism stitched to the first frame member by a common sewn attachment, wherein the width dimension of the first frame member is less than a width dimension of the at least one panel of the first outer portion or the second outer portion.

2. The luggage item according to claim 1, wherein:

the first frame member comprises at least a planar portion extending along the width dimension away from the peripheral edge; and at least a portion of the relatively flexible cover member at least a portion of the closing mechanism and the planar portion of the first frame member substantially align or overlap at a location where they are joined by the common sewn attachment.

3. The luggage item according to claim 1, wherein:

the first frame member includes a portion comprising a honeycomb board.

4. The luggage item according to claim 3, wherein:

the relatively flexible cover member, the closing mechanism and the first frame member are joined together by at least one line of stitching through the portion of the first frame member comprising the honeycomb board.

5. The luggage item according to claim 1, wherein:

the relatively flexible cover member defines at least in part an exterior surface of the at least one of the first outer portion or the second outer portion; and the relatively flexible cover member is configured to substantially cover or overlap an exterior surface of the first frame member.

6. The luggage item according to claim 1, wherein:

the first frame member is configured to form a continuous loop.

7. The luggage item according to claim 6, wherein:

the continuous loop is formed by joining two ends of an elongated member; and the joint of the two ends of the elongated member is preferably positioned adjacent to a top region of the luggage item.

8. The luggage item according to claim 1, wherein:

the first frame member includes a varying thickness across the width dimension.

9. The luggage item according to claim 1, wherein:

the first frame member includes a thinner portion defining a smaller thickness dimension of at least a portion of the width dimension of the first frame member; and at least a portion of the relatively flexible cover member and at least a portion of the closing mechanism are joined to the thinner portion of the first frame member by the common sewn attachment.

10. The luggage item according claim 9, wherein:

the thinner portion of the first frame member is configured to be adjacent to the peripheral edge of the at least one of the first outer portion or the second outer portion.

11. The luggage item according to claim 1, further comprising:

a liner positioned in the interior of the luggage compartment and at least partially adjacent to an inner side of the peripheral edge of the first frame member; and the liner joined to the first frame member by the common sewn attachment joining the relatively flexible cover member and the closing mechanism to the first frame member.

12. The luggage item according to claim 1, further comprising:

a structural member for providing three-dimensional shape support to the luggage item;

the structural member including a first brace member defining opposing ends, and a length extending between the opposing ends;

one of the opposing ends of the first brace member associated with a first portion of the first frame member; and the other one of the opposing ends of the first brace member associated with a second portion of the first frame member.

13. The luggage item according to claim 12, wherein:

the structural member includes at least one polymeric sheet defining at least a portion of a top of the at least one of the first outer portion or the second outer portion; and the at least one polymeric sheet is joined to the first frame member by the common sewn attachment.

14. The luggage item according to claim 1, wherein the first frame member extends across an entirety of a bottom panel of the at least one of the first outer portion or the second outer portion.

15. The luggage item according to claim 1, wherein the width dimension of the first frame member is less than a width dimension of at least one of a top, left, or right panel of the at least one of the first outer portion or the second outer portion.

16. The luggage item according to claim 15, wherein the width dimension of the first frame member across a top panel is less than the width dimension of the first frame member across a left and right panel.

17. The luggage item according to claim 1, wherein the width dimension of the first frame member is greatest along a bottom portion of the first frame member.

18. A luggage item comprising:

first and second outer portions defining an inner compartment of the luggage item;

at least one of the first outer portion or the second outer portion including a frame structure, at least one panel and a relatively flexible cover member; and a closing mechanism operably engaging a peripheral edge of each of the first and second outer portions and configured to selectively open and close the luggage item;

the frame structure comprising a first frame member and at least one brace member;

the first frame member forming at least a portion of a peripheral edge of at least one of the first outer portion or the second outer portion;

the first frame member defining a varying width dimension extending in a direction away from the peripheral edge;

the width dimension of the first frame member is less than a width dimension of the at least one panel of the first outer portion or the second outer portion;

the at least one brace member including opposing ends, and a length extending between the opposing ends;

one of the opposing ends of the at least one brace member associated with a first portion of the first frame member;

the other one of the opposing ends of the at least one brace member associated with a second portion of the first frame member; and the relatively flexible cover member and the closing mechanism stitched to the first frame member by a common sewn attachment.

* * * * *